US006308595B1

(12) United States Patent
Georgeson

(10) Patent No.: US 6,308,595 B1
(45) Date of Patent: Oct. 30, 2001

(54) RATCHETING SPRING WRENCH

(75) Inventor: Jim D. Georgeson, Canyon Country, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/391,584

(22) Filed: Sep. 7, 1999

(51) Int. Cl.[7] ..... B25B 13/52
(52) U.S. Cl. ..... 81/64; 81/486
(58) Field of Search ..... 81/64, 486, 3.43, 81/177.2, 176.15; 24/488; 482/107

(56) References Cited

U.S. PATENT DOCUMENTS

| | | | | |
|---|---|---|---|---|
| 648,060 | * | 4/1900 | Yorty | 81/64 |
| 786,505 | * | 4/1905 | Loofbourrow | 81/3.43 |
| 1,422,308 | * | 7/1922 | Schleicher | 81/3.43 |
| 2,277,500 | * | 3/1942 | Murray | 81/64 |
| 3,269,226 | * | 8/1966 | Von Tersch | 81/64 |
| 4,079,642 | * | 3/1978 | Scott | 81/64 |
| 4,569,105 | * | 2/1986 | Weider | 24/488 |
| 5,392,673 | * | 2/1995 | Scott | 81/177.2 |

OTHER PUBLICATIONS

Body–Solid Fitness Equipment Catalog, 1993, p. 29.*

* cited by examiner

*Primary Examiner*—Joseph J. Hail, III
*Assistant Examiner*—David B Thomas
(74) *Attorney, Agent, or Firm*—Menotti J. Lombardi; ITT Fluid Technology

(57) ABSTRACT

A device for manually rotating a shaft in a substantially continuous manner, the device having a coiled spring-like body having at least one and a half coils, a pair arms extending laterally from the ends of the body, each arm integral with one of the coils, and an extension handle coupled to the end of each arm. The extension handles can be telescopically adjustable if desired. Further, the wrench can be permanently mounted on the outer surface of a shaft to enable convenient rotation of the shaft without additional tools. Additionally, the shaft and wrench assembly can form a component of an electrical pressure switch or like apparatus.

13 Claims, 5 Drawing Sheets

RATCHETING SPRING WRENCH

FIELD OF INVENTION

This invention relates to devices that manually rotate shafts, and in particular, to a ratcheting spring wrench for rotating a shaft.

BACKGROUND OF THE INVENTION

Shafts adapted as adjustment screws and the like, can be manually rotated to effect some type of adjustment by forming some sort of drive tool receiving structure at the end of or on the shaft, and using a correspondingly adapted driving tool to rotate the shaft. A typical drive tool receiving structure can include a hexagonal-shaped head (hex-heads) provided at the end of the shaft for use with conventional wrenches. Another common shaft drive arrangement can include a plurality of slots cut into the shaft such that they extend parallel with the axis of the shaft around the perimeter thereof. Rotation of the shaft is effected by inserting a screwdriver or similar object into one of the slots and prying in the direction of the desired rotation of the shaft. After some amount of rotation is achieved, the screwdriver is removed and reinserted into the end of the slot for further rotation.

There are several disadvantages associated with the above method. One disadvantage is that a separate drive tool must be provided. Another disadvantage is that the drive tool must be repeatedly removed from and then reinserted in the drive tool receiving structure for every rotational stroke of the shaft. This becomes very tedious if the shaft requires many revolutions.

A further disadvantage of the above method is that that there must be adequate physical access or clearance to the drive tool receiving structure to allow an effective stroke angle. If physical access or clearance to the drive tool receiving structure is inadequate, the stroke can be limited to a small angle that will not be effective in rotating shaft. In the case of shafts with hex-heads, there must be adequate clearance for placing the wrench over the next set of hex-head flats. In the case of the slotted shafts, the slot dimension and mechanical slop between the screwdriver and the slot limit the stroke angle.

Accordingly, an improved method for rotating a shaft is required that substantially eliminates the disadvantages associated with the above method.

SUMMARY OF THE INVENTION

A device for manually rotating a shaft in a substantially continuous manner, the device comprising a coiled spring-like body having at least one and a half coils, a pair of arms extending laterally from the ends of the body, each arm integral with one of the coils, and an extension handle coupled to the end of each arm.

In one embodiment of the invention, the extension handles can be telescopically adjustable.

In another embodiment the wrench can be permanently mounted on the outer surface of a shaft to enable convenient rotation of the shaft without additional tools.

In still another embodiment, the shaft and wrench assembly can form a component of an electrical pressure switch of like apparatus.

BRIEF DESCRIPTION OF THE DRAWINGS

The advantages, nature and various additional features of the invention will appear more fully upon consideration of the illustrative embodiment now to be described in detail in connection with accompanying drawings wherein.

It should be understood that these drawings are for purposes of illustrating the concepts of the invention and are not to scale.

DETAILED DESCRIPTION OF THE INVENTION

Figure 1:
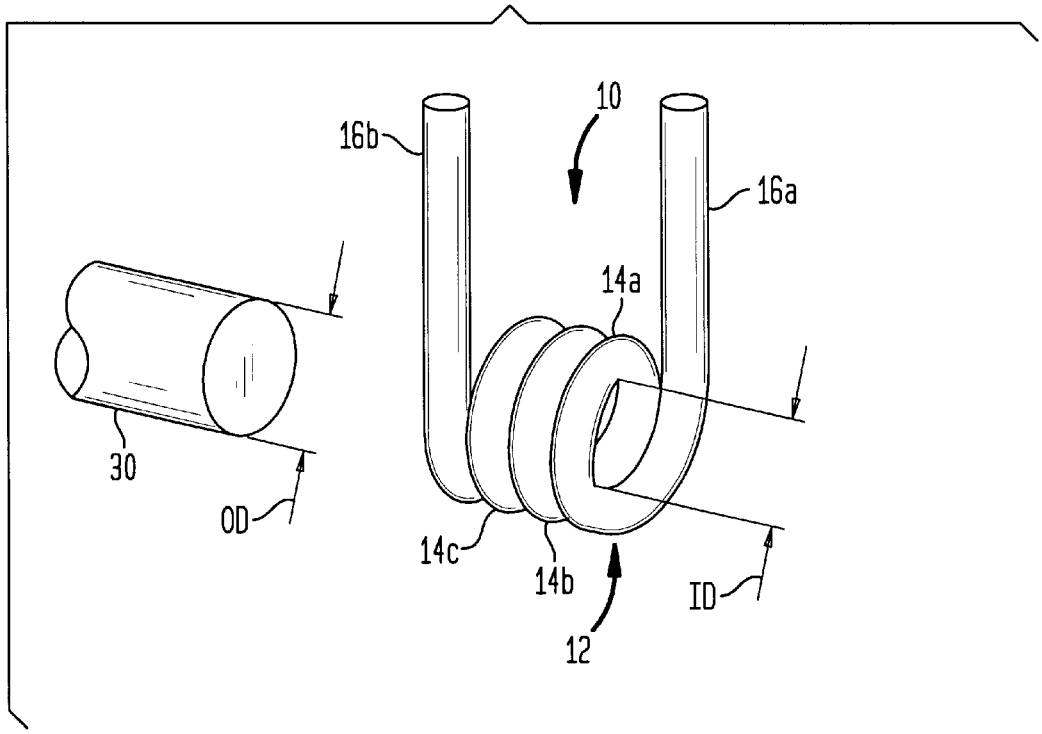
FIG. 1 is a perspective view of a ratcheting spring wrench according to an embodiment of the invention.

FIG. 1 shows a ratcheting spring wrench 10 according to an embodiment of the invention. The wrench 10 comprises a cylindrical body 12 formed by at least one and a half and preferably three expandable and contractible coils 14*a,* 14*b,* 14*c* of round metallic spring wire, arranged as torsion spring. The coils 14*a,* 14*c* at the ends of the body 12 terminate with straight, handle-like arms 16*a,* 16*b* which extend laterally from the body 12. In a preferred embodiment (as shown), the arms 16*a,* 16*b* extend laterally from the body in the same general direction.

Each coil 14*a,* 14*b,* 14*c* has an inner diameter ID which is dimensioned to be slightly smaller than the outer diameter OD of a shaft 30 to be rotated by the wrench 10. When the wrench 10 is installed on the shaft 30, the coils 14*a,* 14*b,* 14*c* lightly grip the shaft's outer surface therefore, preventing the wrench 10 from freely spinning on or sliding off the shaft 30. This is due to the slight pressure created by expansion of the coils 14*a,* 14*b,* 14*c* on the slightly larger diameter shaft 30 which creates a slight resistance to rotation between the shaft 30 and the wrench 10.

Figure 2:
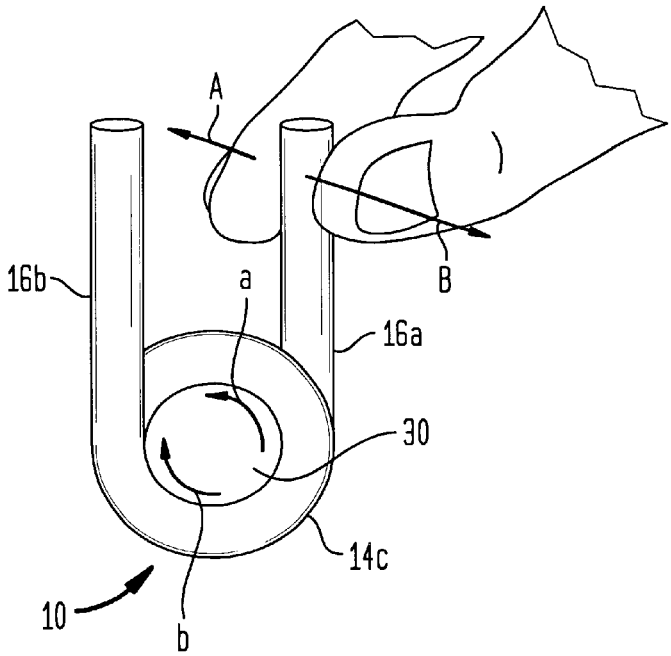
FIG. 2 is an end elevational view of the spring wrench shown in FIG. 1.

The operation of the wrench 10 will now be described with reference to FIG. 2. As shown, a force applied to one of the coil arms 16*a* in the direction indicated by arrow A, attempts to contract the inner diameter of the associated outer coil 14*a* of the wrench 10 thereby causing it to apply a high frictional torque to the outer surface of the shaft 30. This application of high frictional torque holds the wrench 10 stationary with the shaft 30 thereby causing the shaft 30 to rotate with the wrench 10 in the direction of arrow a Because the wrench 10 lightly grips the shaft 30, the application of rotational torque is immediate and enables the wrench 10 to activate over a very small angular displacement. A force applied to the same coil arm 16*a* in the opposite direction indicated by arrow B expands the inner diameter of the coil 14*a* thereby causing it to release the shaft's outer surface and rotate back to its original position without rotating the shaft 30. Thus, repeatedly moving the arm 16*a* back and forth in the directions of arrows A and B produces a ratcheting action that can be used for rotating the shaft 30 in a substantially continuous manner in the direction of arrow a The shaft 30 can be rotated in the direction of arrow b by operating the other arm 16*b* of the wrench 10 in the same manner as described above. Simultaneously pulling the arms 16*a,* 16*b* away from each other increases the inner diameter ID of the outer coils 14*a,* 14*c* to allow the wrench 10 to be easily mounted or removed from the shaft 30.

As described and shown, the ratcheting spring wrench 10 of the invention is capable of turning the shaft 30 with a ratcheting action that requires little attention or energy from the user. Moreover, the wrench 10 can remain on the shaft 30 so that the user does not need any extra tools. Because the wrench 10 activates over a very small angular displacement its ratcheting action can achieve shaft rotation even if physical access to the shaft is very limited. Accordingly, the wrench 10 can be used anywhere a shaft needs to be manually rotated, whether for turning a screw in or out or merely turning a shaft in angular rotation.

Figure 3A:
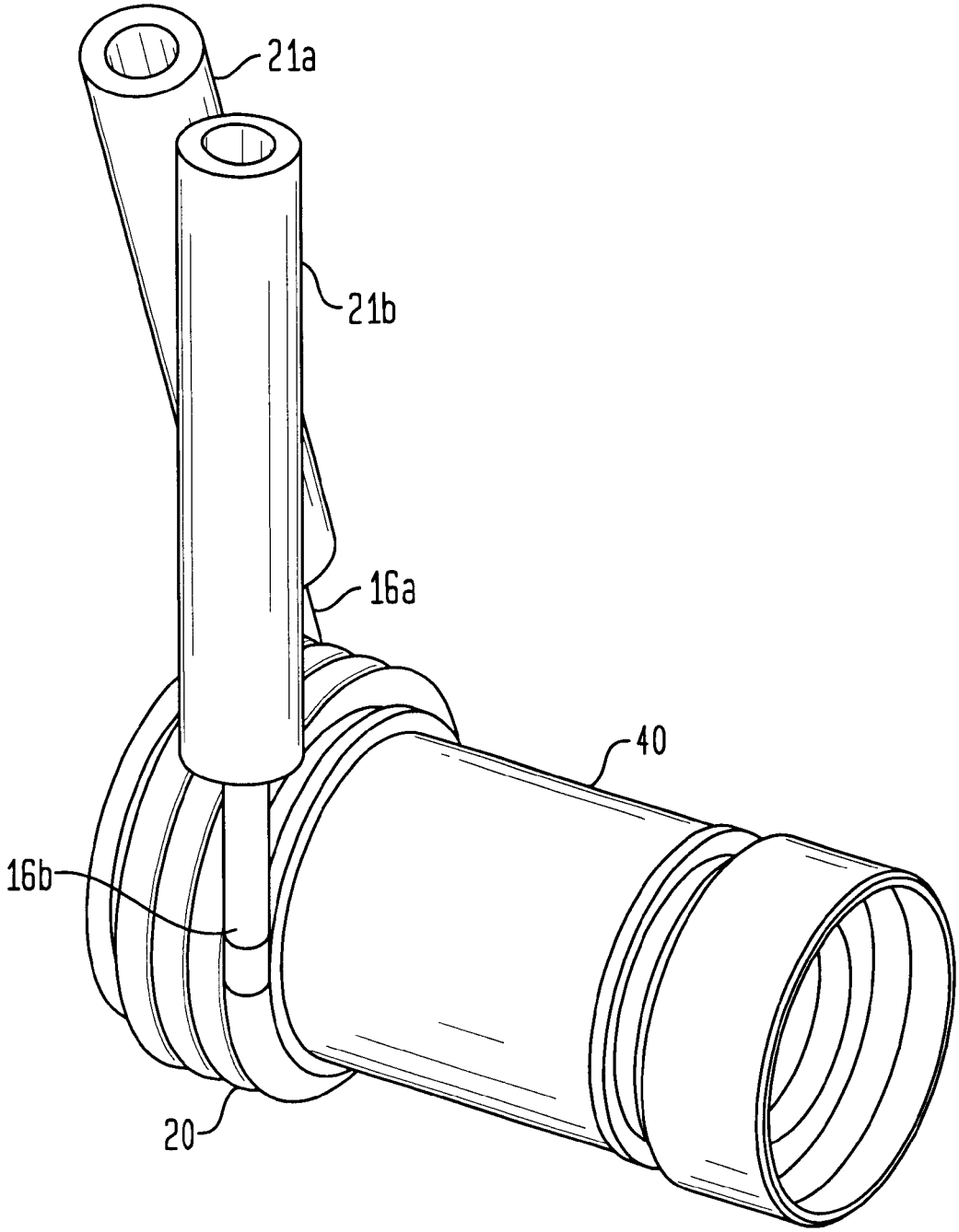
FIG. 3A is a perspective view of a ratcheting spring wrench according to a second embodiment of the invention.
Figure 3B:
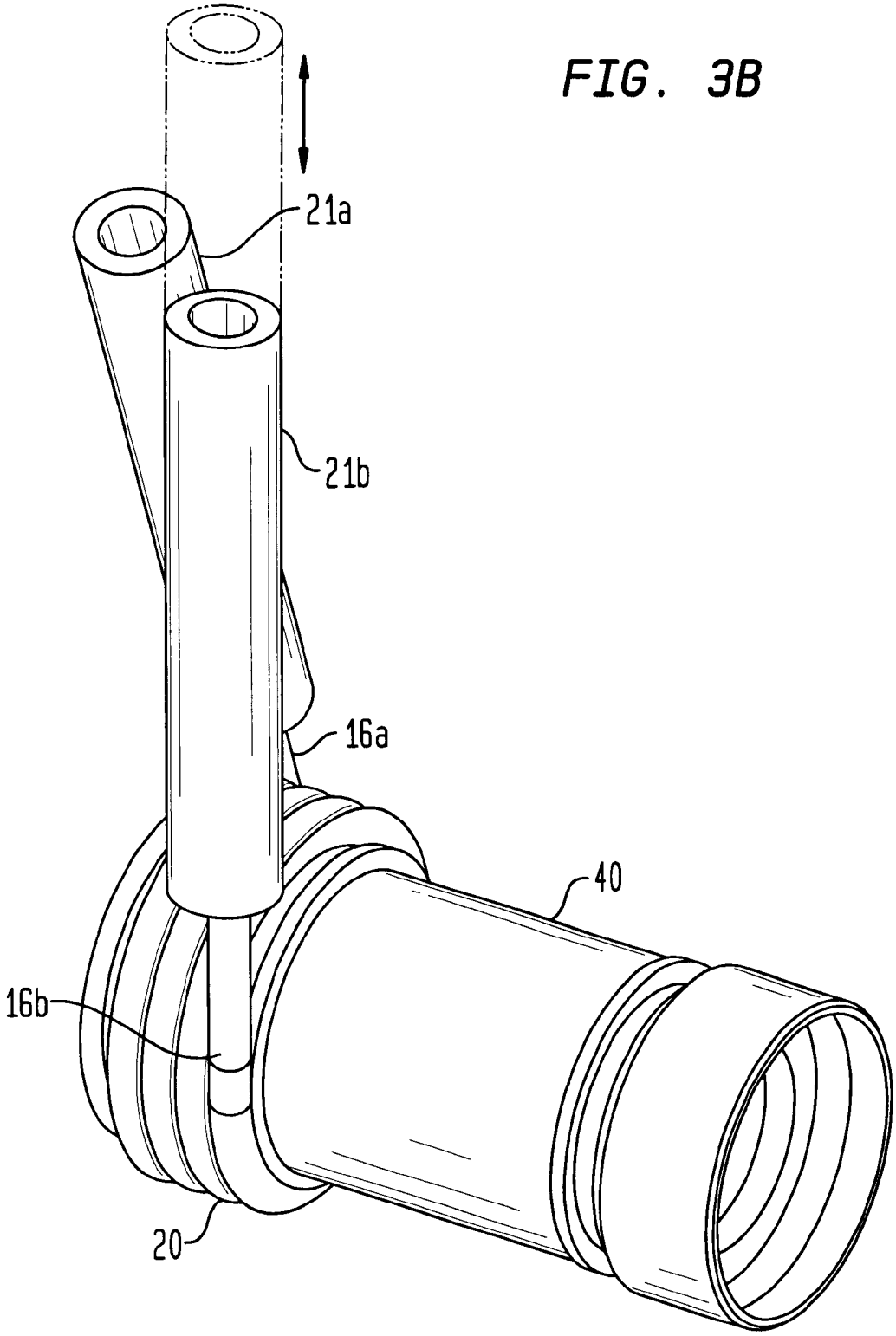
FIG. 3B is a perspective view of the ratcheting spring wrench of FIG. 3A with modified handle extensions.

FIG. 3 shows a wrench 20 according to a second embodiment of the invention mounted onto a shaft 40. The wrench 20 is substantially identical to the previous embodiment of FIG. 1 except that it includes cylindrical handle extensions 21*a,* 21*b* attached to the free ends of the arms 16*a,* 16*b.* The extension handles 21*a,* 21*b* facilitate gripping of the arms 16*a,* 16*b,* provide additional mechanical leverage, and provide greater control and resolution over shaft rotation. The extension handles 21*a,* 21*b* can be telescopically constructed as shown in FIG. 3B so that they can be extended to provide additional mechanical advantage and control.

Figure 4:
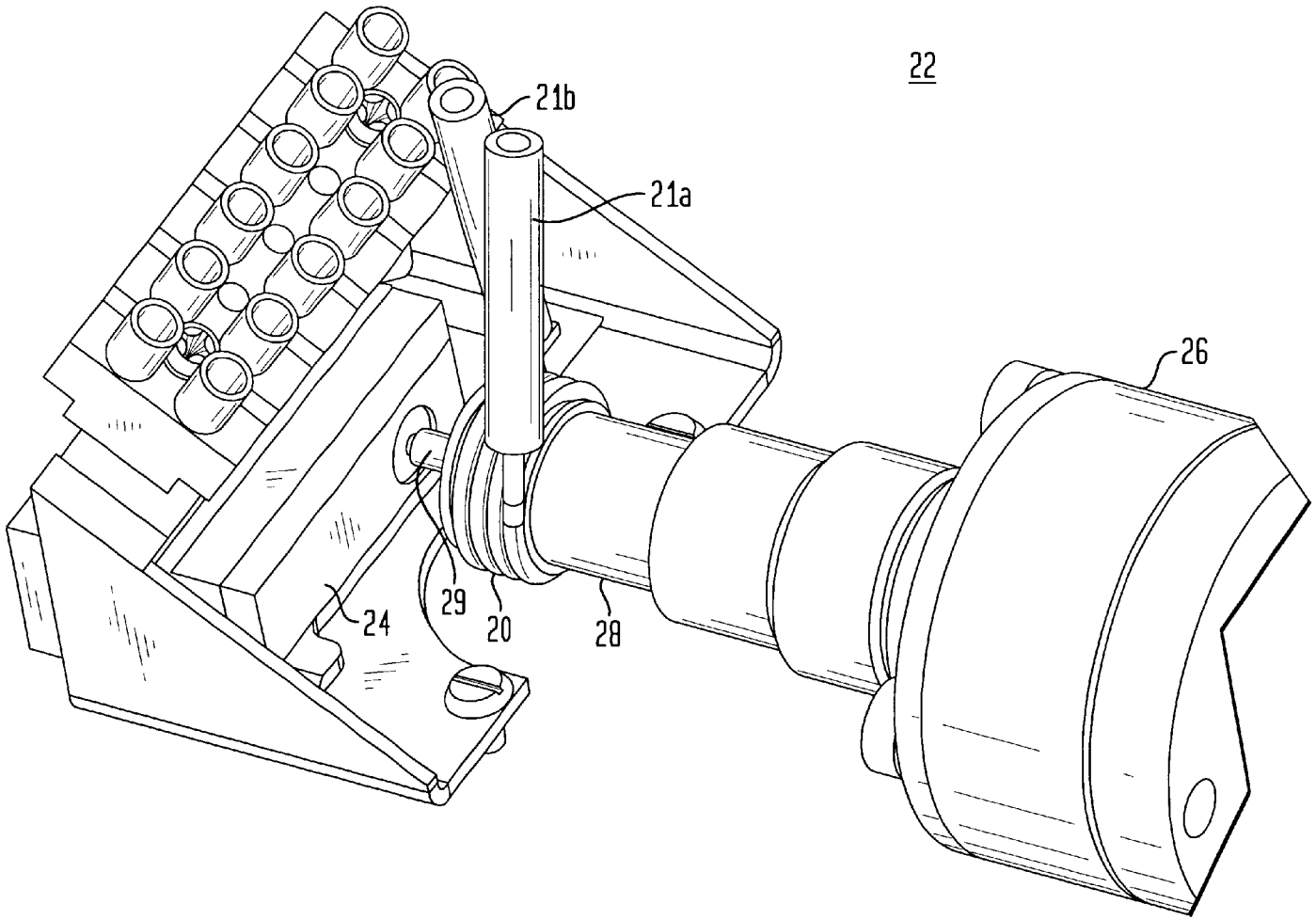
FIG. 4 is a perspective view of the ratcheting spring wrench of FIG. 3A permanently mounted on a shaft of an electrical pressure switch.

FIG. 4 shows a typical electrical pressure switch 22 whose pressure set point can be conveniently adjusted using the wrench 20 of the invention. The electrical pressure switch 22 comprises an electrical switch 24 and a mechanical pressure capsule assembly 26. The capsule assembly 26 includes an adjustment screw 28 that compresses a spring (not visible) within the capsule assembly 26 that changes the pressure set point thereof Rotating the adjustment screw 28 into the capsule assembly 26 compresses the spring, thereby increasing the pressure set point of the assembly. Rotating the screw 28 out of the capsule assembly decreases its pressure set point. An actuator shaft 29 coupled to the free end of the adjustment screw 28 actuates the electrical switch 24 when the capsule assembly 16 reaches a selected pressure setpoint.

The wrench 20 of the invention (illustrated with the embodiment of the wrench shown in FIG.3) is permanently mounted on the adjustment screw 28 of the capsule assembly 26. Moving one of the two handle extensions 21*a,* 21*b* of the wrench 20 in a back and forth ratcheting manner as described earlier, rotates the adjustment screw 28 into the capsule assembly 26, while moving the other one of the two handle extensions 21*a,* 21*b* in a back and forth ratcheting manner rotates the adjustment screw 28 in the opposite direction out of the capsule assembly 26.

Figure 5:
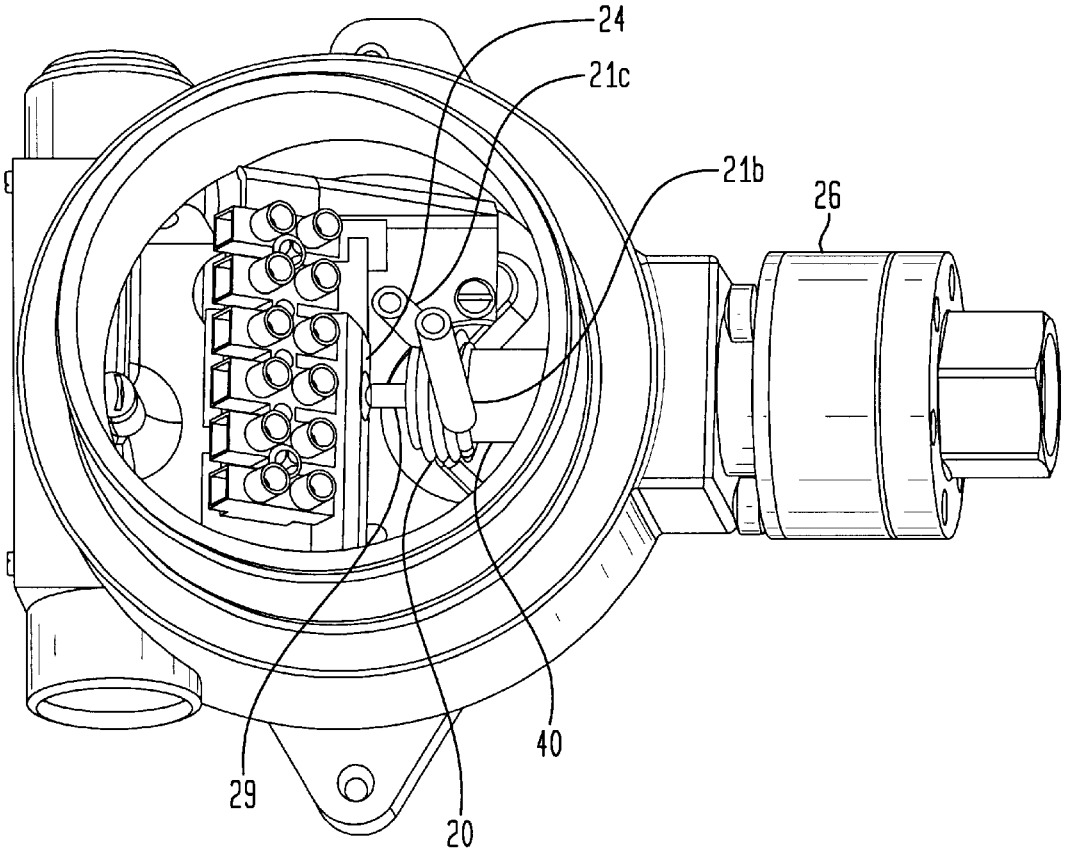
FIG. 5 is a perspective view of the electrical pressure switch and ratcheting spring wrench of FIG. 4 in a typical enclosure.

FIG. 5 shows the electrical pressure switch 22 and wrench 20 of FIG. 4 encased in a deep enclosure 32 which precludes the use of a conventional wrench. The wrench 20 of the invention is especially useful in such enclosures because it activates over a very small angular displacement.

While the foregoing invention has been described with reference to the above embodiments, various modifications and changes can be made without departing from the spirit of the invention. Accordingly, all such modifications and changes are considered to be within the scope of the appended claims.

What is claimed is:

1. A device for manually rotating a shaft in a substantially continuous manner, the device comprising:

a coiled spring-like body having at least one and a half coils, said coils adapted to fit around a rotatable shaft; and a pair of arms extending laterally from the ends of the body in the same general direction, each arm integral with one of the coils, whereby a force applied in a forward and backward direction to one of said arms enables the device to rotate said shaft in a substantially continuous manner.

2. The device according to claim 1, wherein the coils are constructed from round metallic spring wire.

3. The device according to claim 1, further comprising an extension handle coupled to the end of each arm.

4. The device according to claim 3, wherein the extension handles are telescopically adjustable.

5. A rotatable shaft assembly comprising;

a rotatable shaft having a cylindrical outer surface;

a ratcheting spring wrench device mounted on the outer surface of the shaft, for manually rotating the shaft in a substantially continuous manner, the device having a coiled spring-like body with at least one and a half coils, said coils adapted to fit around said shaft; and a pair of arms extending laterally from the ends of the body in the same general direction, each arm integral with one of the coils, whereby a force applied in a backward and forward direction to one of said arms enables the device to rotate said shaft in a substantially continuous manner.

6. The shaft assembly according to claim 5, wherein the coils are constructed from round metallic spring wire.

7. The shaft assembly according to claim 5, wherein the shaft is an adjustment screw.

8. The shaft assembly according to claim 5, wherein the shaft is a component of an electrical switch.

9. The shaft assembly according to claim 5, wherein the shaft is a component of an electrical pressure switch.

10. The shaft assembly according to claim 8, wherein the shaft changes a predetermined pressure set point of the switch when rotated by the ratcheting spring wrench device.

11. The device according to claim 8, wherein the shaft is an adjustment screw that changes a predetermined pressure set point of the switch when rotated by the ratcheting spring wrench device.

12. The shaft assembly according to claim 5, further comprising an extension handle coupled to the end of each of said arms.

13. The shaft assembly according to claim 12, wherein the extension handles are telescopically adjustable.

* * * * *